US007714680B2

(12) United States Patent
Vangala et al.

(10) Patent No.: US 7,714,680 B2
(45) Date of Patent: May 11, 2010

(54) CERAMIC MONOBLOCK FILTER WITH INDUCTIVE DIRECT-COUPLING AND QUADRUPLET CROSS-COUPLING

(75) Inventors: Reddy Vangala, Albuquerque, NM (US); Tri Dinh, Albuquerque, NM (US)

(73) Assignee: CTS Corporation, Elkhart, IN (US)

( * ) Notice: Subject to any disclaimer, the term of this patent is extended or adjusted under 35 U.S.C. 154(b) by 6 days.

(21) Appl. No.: 11/803,506

(22) Filed: May 15, 2007

(65) Prior Publication Data

US 2007/0279150 A1 Dec. 6, 2007

Related U.S. Application Data

(60) Provisional application No. 60/809,505, filed on May 31, 2006.

(51) Int. Cl.
*H01P 1/20* (2006.01)
*H01P 7/04* (2006.01)

(52) U.S. Cl. ..... 333/134; 333/206; 333/222

(58) Field of Classification Search ..... 333/134, 333/206, 207, 222, 223, 227
See application file for complete search history.

(56) References Cited

U.S. PATENT DOCUMENTS

| | | | | |
|---|---|---|---|---|
| 4,692,726 | A | 9/1987 | Green et al. | |
| 4,740,765 | A * | 4/1988 | Ishikawa et al. | 333/206 |
| 4,742,562 | A | 5/1988 | Kommrusch | |
| 4,823,098 | A | 4/1989 | DeMuro et al. | |
| 4,891,615 | A | 1/1990 | Komazaki et al. | |
| 5,214,398 | A | 5/1993 | Hayashi | |
| 5,227,747 | A | 7/1993 | Komazaki et al. | |
| 5,307,036 | A | 4/1994 | Turunen et al. | |
| 5,486,799 | A | 1/1996 | Komazaki et al. | |
| 5,793,267 | A | 8/1998 | Tada et al. | |
| 5,864,264 | A | 1/1999 | Hino | |

(Continued)

FOREIGN PATENT DOCUMENTS

| | | |
|---|---|---|
| EP | 0 364 931 | 4/1990 |

(Continued)

OTHER PUBLICATIONS

Alex D. Lapidus and Chris Rossiter, Cross-coupling in Microwave Bandpass Filters, Microwave Journal, Nov. 2004, Horizon House Publications, Inc., Norwood, MA.

(Continued)

*Primary Examiner*—Robert Pascal
*Assistant Examiner*—Kimberly E Glenn
(74) *Attorney, Agent, or Firm*—Daniel J. Deneufbourg

(57) ABSTRACT

A ceramic monoblock filter including a direct signal path defined by at least four spaced-apart through-hole resonators in combination with ground bars extending between the through-hole resonators and a separate quadruplet cross-coupling alternate signal path defined by two conductive pads located adjacent the first and fourth ones of the through-hole resonators respectively and a separate external bridge member which interconnects and couples the two pads. The bridge member is preferably made of a material having a lower dielectric constant than the block of the filter. In one embodiment, the filter is a monoblock duplexer filter comprising respective transmit and receive sections each including at least four of the through-hole resonators, the ground bars, the two pads, and the bridge member. In the duplexer embodiment, additional through-hole resonators may define shunt zeros.

10 Claims, 4 Drawing Sheets

U.S. PATENT DOCUMENTS

| | | | | |
|---|---|---|---|---|
| 5,896,073 | A | 4/1999 | Miyazaki et al. | |
| 5,926,079 | A * | 7/1999 | Heine et al. | 333/208 |
| 6,169,464 | B1 | 1/2001 | Moon et al. | |
| 6,169,465 | B1 | 1/2001 | Kim et al. | |
| 6,404,306 | B1 | 6/2002 | Kitajima et al. | |
| 6,559,735 | B1 | 5/2003 | Hoang et al. | |
| 6,650,202 | B2 | 11/2003 | Rogozine et al. | |
| 6,809,612 | B2 | 10/2004 | Bloom et al. | |
| 7,076,388 | B2 | 7/2006 | Rogozine et al. | |
| 2001/0008388 | A1 | 7/2001 | Jun et al. | |
| 2006/0267712 | A1 * | 11/2006 | Morga | 333/202 |

FOREIGN PATENT DOCUMENTS

| | | |
|---|---|---|
| JP | 62-77703 | 4/1987 |
| JP | 02 101603 | 8/1990 |
| JP | 3-212003 | 9/1991 |
| JP | 3-252201 | 11/1991 |
| JP | 5-175708 | 7/1993 |
| WO | WO 83/02853 | 8/1983 |
| WO | WO 01/11711 | 2/2001 |

OTHER PUBLICATIONS

Den Otter, Adrianus, PCT International Search Report mailed Oct. 10, 2007 re: International Application No. PCT/US2007/011596 filed May 15, 2007.

Den Otter, Adrianus, PCT Written Opinion of the International Searching Authority mailed Oct. 10, 2007 re: International Application No. PCT/US2007/011596 filed May 15, 2007.

* cited by examiner

CERAMIC MONOBLOCK FILTER WITH INDUCTIVE DIRECT-COUPLING AND QUADRUPLET CROSS-COUPLING

CROSS-REFERENCE TO RELATED APPLICATIONS

This application claims the benefit of the filing date and disclosure of U.S. Provisional Application Ser. No. 60/809,505 filed on May 31, 2006 which is explicitly incorporated herein by reference as are all references cited therein.

FIELD OF THE INVENTION

This invention relates to electrical filters and, in particular, to a dielectric ceramic monoblock filter adapted to provide inductive direct-coupling and quadruplet cross-coupling.

BACKGROUND OF THE INVENTION

Ceramic dielectric block filters offer several advantages over air-dielectric cavity filters. The blocks are relatively easy to manufacture, rugged, and relatively compact. In the basic ceramic block filter design, resonators are formed by cylindrical passages called through-holes which extend between opposed top and bottom surfaces of the block. The block is substantially plated with a conductive material (i.e., metallized) on all but one of its six (outer) sides and on the interior walls of the resonator through-holes.

The top surface is not fully metallized but instead bears a metallization pattern designed to couple input and output signals through the series of resonators. In some designs, the pattern may extend to the sides of the block, where input/output electrodes are formed.

The reactive coupling between adjacent resonators is dictated, at least to some extent, by the physical dimensions of each resonator, by the orientation of each resonator with respect to the other resonators, and by aspects of the top surface metallization pattern. These filters may also be equipped with an external metallic shield attached to and positioned across the open-circuited end of the block in order to minimize parasitic coupling between non-adjacent resonators and to achieve acceptable stopbands.

Although such RF signal filters have received widespread commercial acceptance since the 1970s, efforts at improvement on this basic design have continued to the present.

One such improvement has been the use of what is commonly referred to in the art as "capacitive cross-coupling" to increase the attenuation characteristics of a filter at frequencies below the passband thereof. An example of a filter incorporating a triplet capacitive cross-coupling design is disclosed in U.S. Pat. No. 6,559,735 to Vangala et al. in the form of a linear bypass electrode printed onto the top surface of the filter. This triplet cross-coupling design, however, cannot be used to place zeros to increase attenuation at frequencies above the passband of a ceramic monoblock filter inasmuch as the cross-coupling needs to be inductive (see, for example, "Cross-coupling in Microwave Bandpass Filters", Microwave Journal, November 2004) and thus does not lend itself to practical implementation.

Moreover, in the triplet cross-coupling design of U.S. Pat. No. 6,559,735 increased attenuation below the passband is accomplished at the expense of attenuation above the passband. Although such skewed filter response is adequate for the consumer handset-related applications, it is not adequate for the cellular infrastructure base station-related applications where a more symmetrical response is desirable.

Still further, the cross-coupling triplet design precludes the use of ground-bars or notches between adjacent resonators, i.e., a feature which allows not only fine adjustments to inter-resonator coupling, as explained in U.S. Pat. No. 4,692,726 to Green et al., but also improves the overall out-of-band attenuation level by providing inductive coupling between resonators.

Therefore, the need continues for an improved RF filter which can offer improved attenuation on both the low and high sides of the passband while also making the filter response more symmetrical without increasing the filter size or cost of manufacturing. The present invention meets these and other needs.

SUMMARY OF THE INVENTION

The present invention is directed to a ceramic monoblock filter comprising a block of dielectric material defined by top, bottom, and side surfaces wherein the side and bottom surfaces are substantially covered with a conductive material. First, second, third, and fourth spaced-apart resonators are defined by at least four adjacent resonator through-holes extending between the top and bottom surfaces of the block and surrounded on the top surface by conductive material defining conductive resonator plates. First and second pads of conductive material are also defined on the top surface, the first pad being located adjacent the first resonator and the second pad being located adjacent the fourth resonator. An external bypass transmission electrode is adapted to conductively connect the first pad to the second pad and provide a capacitive cross-coupling (i.e., alternative signal path) directly between the first and fourth resonators.

Inductive coupling means located between each of the first through fourth resonators are adapted to provide a direct coupling (i.e., direct signal path) between the first through fourth resonators.

In one embodiment, the inductive coupling means comprises respective first, second, and third strips of conductive material extending between the first and second, second and third, and third and fourth resonators respectively. In another embodiment, the inductive coupling means comprises first, second, and third elongate notches defined in the dielectric material of the block between the first and second, second and third, and third and fourth resonators respectively.

In one embodiment, the external bypass transmission electrode is defined by a bar composed of a material having a dielectric constant less than the dielectric constant of the material comprising the block of the filter and the ends of the bar are seated on the respective first and second pads. A strip of conductive material is disposed on the bar for connecting the first pad to the second pad. Suitable materials for the bar include ceramic, FR4, or glass. The bar may be straight, of non-uniform width, or of a meandering configuration, depending upon the application.

In a preferred embodiment, the filter is a ceramic monoblock duplexer filter defining respective transmit and receive sections, each including the first through fourth resonators, first and second pads, external bypass transmission electrode and inductive coupling means.

BRIEF DESCRIPTION OF THE DRAWINGS

These and other features of the invention can best be understood by the following description and the accompanying FIGURES as follows.

DETAILED DESCRIPTION OF THE PREFERRED EMBODIMENT

While this invention is susceptible to embodiment in many different forms, this specification and the accompanying FIGURES disclose only one preferred form as an example of the invention. The invention is not intended to be limited to the embodiment so described, however. The scope of the invention is identified in the appended claims.

Figure 1:
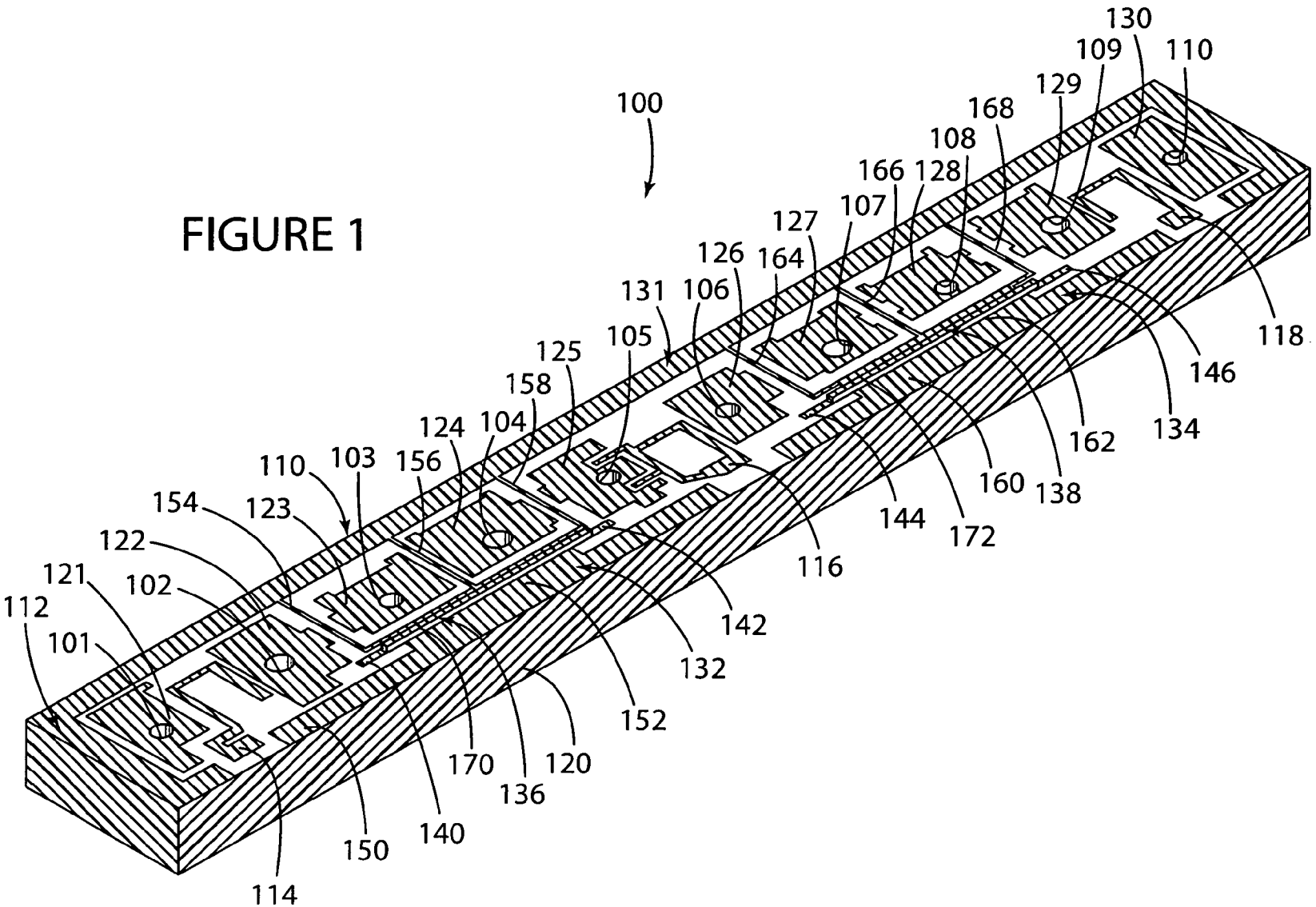
FIG. 1 is a perspective view of a duplexer filter incorporating the features of the present invention.

FIG. 1 shows a preferred embodiment of a filter 100 which incorporates the combined quadruplet cross-coupling and inductive direct-coupling features of the present invention. Filter 100 includes a block 110 composed of a dielectric material and selectively plated with a conductive material. Block 110 has a top surface 112, a bottom surface (not shown) and four side surfaces, of which side surface 120 is an example. Filter 100 can be constructed of a suitable dielectric material that has low loss, a high dielectric constant, and a low temperature coefficient.

The plating on block 110 is electrically conductive, preferably copper, silver or an alloy thereof. Such plating preferably covers all surfaces of the block 110 with the exception of top surface 112, the plating of which is described in some detail below. Of course, other conductive plating arrangements can be utilized. See, for example, those discussed in "Ceramic Bandpass Filter," U.S. Pat. No. 4,431,977, Sokola et al., assigned to the present assignee and incorporated herein by reference to the extent it is not inconsistent.

Block 110 includes ten (10) through-holes 101, 102, 103, 104, 105, 106, 107, 108, 109, and 110 (101-110), each extending from the top surface 112 to a bottom surface (not shown) thereof. The interior walls defining through-holes (101-110) are likewise plated with an electrically conductive material. Each of the plated through-holes 101-110 is essentially a transmission line resonator comprised of a short-circuited coaxial transmission line having a length selected for desired filter response characteristics. For an additional description of the through-holes 101-110, reference may be made to U.S. Pat. No. 4,431,977, Sokola et al., supra. Although block 110 is shown with ten plated through-holes 101-110, the present invention is not so limited.

Top surface 112 of block 110 is selectively plated with an electrically conductive material similar to the plating on block 110. The selective plating includes input-output I/O pads or plates, specifically transmit (Tx) electrode 114 adapted for connection to a transmitter, antenna (ANT) electrode 116 adapted for connection to an antenna, and receive (Rx) electrode 118 adapted for connection to a receiver. Also included are resonator plates 121, 122, 123, 124, 125, 126, 127, 128, 129 and 130 (121-130) that surround respective through-holes 101-110 respectively and in combination define respective resonators. Top surface 112 additionally includes ground plates 131, 132 and 134.

Plates 121-130 are used to capacitively couple the transmission line resonators, provided by the plated through-holes 101-110, to ground plating 131, 132 and 134. Ground plate 131 extends along the full peripheral top edge of surface 112. Ground plate 132 extends generally longitudinally along the bottom edge of surface 112 generally between transmit electrode 114 and antenna electrode 116. Ground plate 134 extends generally longitudinally along the bottom edge of surface 112 generally between antenna electrode 116 and receive electrode 118. Portions of plates 121-130 also couple the associated resonators of through-holes 101-110 to transmit electrode 114, antenna electrode 116 and receive electrode 118.

Alternative or cross-coupling signal means 136 and 138 couple non-adjacent resonators of through-holes 101-110 through associated plates 121-130. Plates 121-125, through-holes 101-105, ground plate 132, alternative signal means 136 and transmit electrode 114 together define the transmit section of duplexer filter 100. Plates 126-131, through-holes 106-110, ground plate 134, alternative signal means 138 and receiver electrode 118 together define a receive section of filter 100.

Coupling between the transmission line resonators, provided by the plated through-holes 101-110, is accomplished at least in part through the dielectric material of block 110 and is varied by varying the width of the dielectric material and the distance between adjacent transmission line resonators. The width of the dielectric material between adjacent through-holes 101-111 can be adjusted in any suitable regular or irregular manner as is known in the art, such as, for example, by the use of slots, cylindrical holes, square or rectangular holes, or irregular-shaped holes.

In accordance with the present invention, each of the alternative or cross-coupling signal means 136 and 138 is defined in part by at least capacitive pads 140 and 142 in the transmit section and capacitive pads 144 and 146 in the receive section which have been printed or otherwise defined on the top surface 112 of block 110.

Specifically, in the transverse or width direction of filter 100, pad 140 is located on the top surface 112 in the space between the top edge of the left end portion of ground plate 132 and the lower edges of resonator plates 122 and 123 while, in the longitudinal or length direction of top surface 112, pad 140 is located on the top surface 112 in the space defined between resonator plates 122 and 123. Pad 142, in the transverse or width direction of filter 100, is located on the top surface 112 in the space between the top edge of the right end portion of ground plate 132 and the lower edges of resonator plates 124 and 125 while, in the longitudinal direction of filter 100, pad 142 is located on the top surface 112 in the space defined between resonator plates 124 and 125.

Pad 144, in the transverse or width direction of filter 100 extends between the top edge of the left hand portion of ground plate 134 and below the bottom edge of resonator plates 126 and 127 while, in the longitudinal or length direction of filter 100, pad 144 is located on the top surface 112 in the space defined between the resonator plates 126 and 127. Pad 146, in the transverse or width direction of filter 100, extends between the top edge of the right side end of ground plate 134 and the lower edge of resonator plates 128 and 129 while, in the longitudinal or length direction of filter 100, pad 146 is located on the top surface 112 in the space defined between resonator plates 128 and 129.

Figure 2:
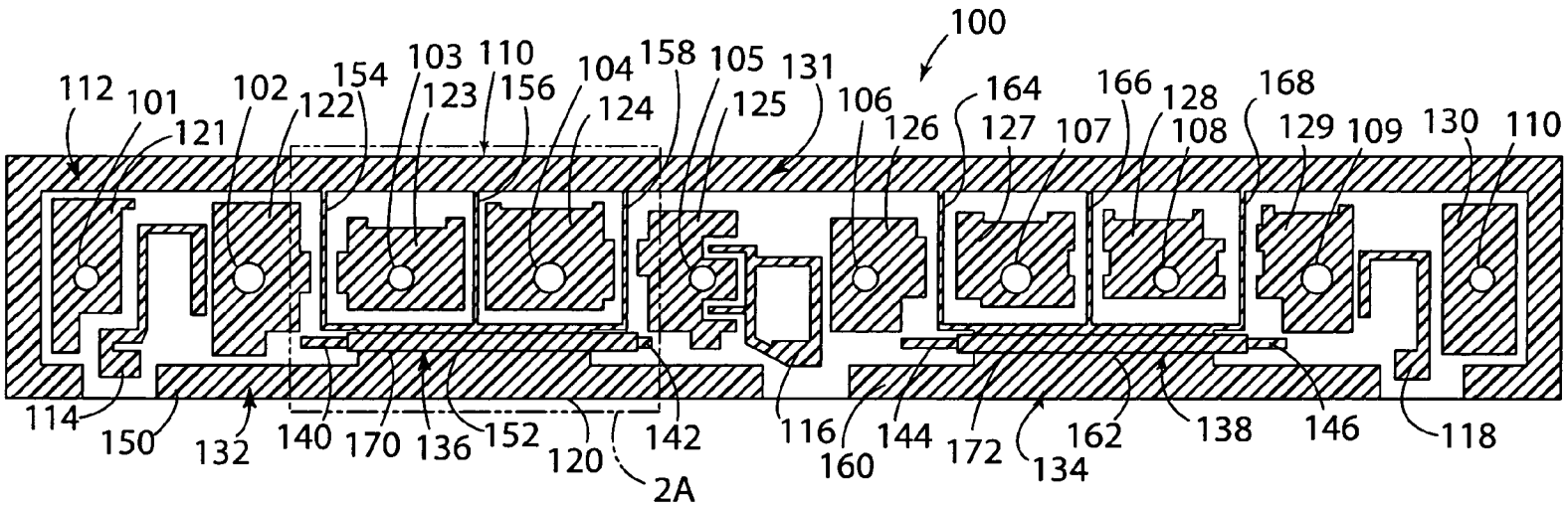
FIG. 2 is a top plan view of the top surface of the duplexer filter shown in FIG. 1.

Referring to FIG. 2, ground plate 132 is defined by a base portion 150 extending along the lower peripheral edge of surface 112 between respective electrodes 114 and 116 and a shoulder or tongue portion 152 extending unitarily outwardly and upwardly away from the top or upper peripheral edge of a central portion of the base 150 thereof which protrudes into and through the space and gap defined between the two spaced-apart and co-linear capacitive pads 140 and 142. Ground plate 132 still further defines a plurality of elongate bars 154, 156, and 158 protruding and extending unitarily outwardly, upwardly and vertically away from the tongue portion 152 and each terminating in the lower peripheral edge of upper ground plate 131. More specifically, bar 154 extends through the space or gap defined between resonator plates 122 and 123, bar 156 extends through the space or gap defined between resonator plates 123 and 124, and bar 158 extends through the space or gap defined between resonator plates 124 and 125.

Figure 2A:
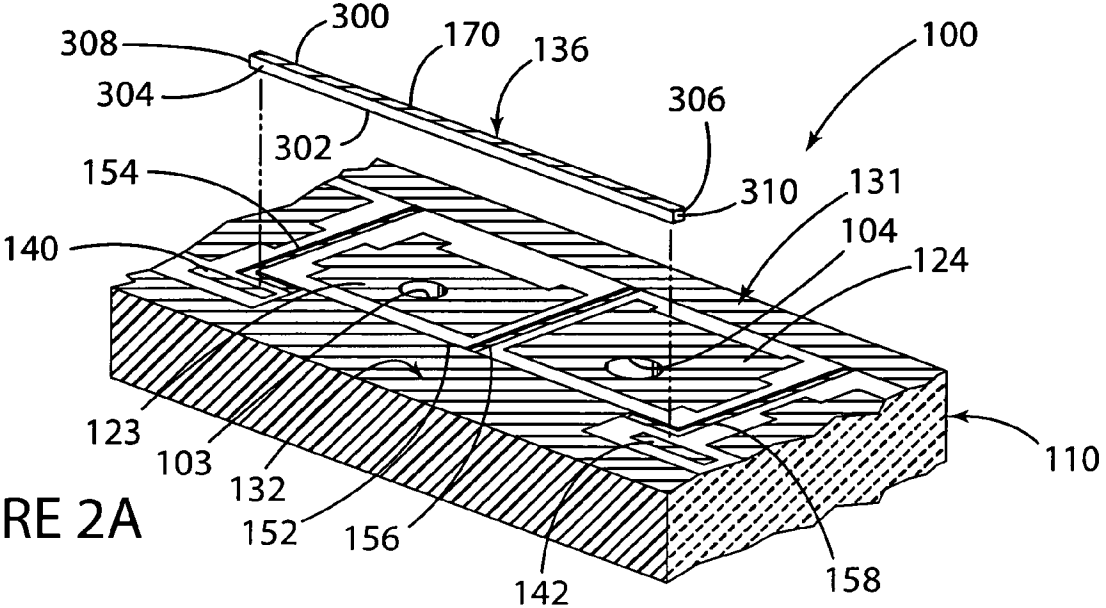
FIG. 2A is a broken, perspective view of the filter taken along line 2A in FIG. 2.

Although bars 154, 156, and 158 are shown in FIGS. 1 and 2 as strips of conductive material printed onto the top surface 112 of filter 110, it is understood that the invention encompasses other suitable ground bar embodiments such as, for example, elongate notches defined in the block 110 as shown in FIG. 2A, i.e., regions of the block 110 from which dielectric material has been removed and then subsequently covered with a conductive material.

In a like manner, and further in accordance with the present invention, ground plate 134 is defined by a base portion 160 extending along the lower peripheral edge of the surface between respective electrodes 116 and 118 and a shoulder or tongue portion 162 extending unitarily outwardly and upwardly away from the top or upper peripheral edge of a central portion of the base 160 which protrudes into and through the space/gap defined between the two spaced-apart and co-linear capacitive pads 144 and 146.

Ground plate 134 still further defines a plurality of elongate, vertically extending ground bars 164, 166, and 168 protruding and extending unitarily outwardly and upwardly away from the tongue 162 and terminating in the lower peripheral edge of upper ground plate 131. More specifically, strip 164 extends through the space/gap defined between resonator plates 126 and 127, strip 166 extends through the space/gap defined between resonator plates 127 and 128, and strip 168 extends through the space/gap defined between resonator plates 128 and 129.

Each of the alternative or cross-coupling signal means 136 and 138 is still further defined by respective external, cross-coupling, bypass transmission line electrodes or bridge members 170 and 172 which, in accordance with the preferred embodiment, are defined by bars or strips composed of a substrate dielectric ceramic material having a dielectric constant of about 8 while the block 110 is preferably composed of a ceramic dielectric material with a dielectric constant of about 37. It is of course understood that bypass bars or bridges 170 and 172 may be composed of any other suitable material with a dielectric constant which is lower than the dielectric constant of block 110 such as, for example, an FR4 type substrate, or glass.

Bar 170 which, in the embodiment shown is straight, is adapted to be seated on the top surface 112 of block 100 in a relationship wherein bar 170 extends in a generally longitudinal direction in the space defined between the lower edges of resonator plates 123 and 124 and the upper edge of the base of ground plate 132 with the respective ends thereof seated over and against the pads 140 and 142 and the body thereof overlying the shoulder 152 of ground plate 132.

In a like manner, bar 172 is adapted to be seated on the top surface 112 in a relationship wherein the bar 172 extends in a generally longitudinal direction on the top surface 112 in the space defined between the lower edges of resonator plates 127 and 128 and the upper edge of the base of ground plate 134 with the respective ends thereof seated over and against the pads 144 and 146 respectively and the body thereof overlying the shoulder 162 of ground plate 134.

A bypass transmission line or strip of conductive material similar to the conductive material defining the various resonator plates and ground plates is printed onto the top face and opposed end faces of each of the bypass bars 170 and 172 so as to define and complete a conductive bypass electrical path between the respective resonator pads 140 and 142; and 144 and 146.

Although not shown or described herein in any detail, it is understood that the invention encompasses embodiments where the bars 170 and 172 are of non-uniform width or of a meandering configuration depending upon the application. Bars 170 and 172 could also be substituted with a wire extending between the pads.

In the embodiment of FIGS. 1, 2 and 2A, bars 170 and 172 define discrete, external, separate bars which are adapted to be secured to the top surface of the filter 100 as by, for example, soldering the same thereto. Moreover, and although FIG. 2A depicts only bar 170, it is understood that each of the bars 170 and 172 define respective top and bottom faces 300 and 302, respective opposed side faces 304 and 306, and respective opposed end faces 308 and 310.

In accordance with the invention, the respective end faces 308 and 310 and the top face 300 are plated with the same type of electrically conductive material as the other electrically conductive plating on the filter top surface 112 including, for example, the plating which defines respective pads 140, 142, 144, and 146 on which the ends of bars 136 and 138 are adapted to be seated. Side faces 304 and 306 and bottom face 302 are not plated with any electrically conductive material and thus define the respective grounded surfaces of bars 170 and 172 respectively.

Capacitive pads 140, 142 and 144, 146 in combination with respective transmission lines 170 and 172 create two signal paths in each of the Tx and Rx sections of the filter 100, i.e., a first main signal path through resonator plates 122-125 and 126-129 respectively and an alternate bypass signal path directly from plate 122 to plate 125 in the Tx section and directly from plate 126 to plate 129 in the Rx section.

Figure 3:
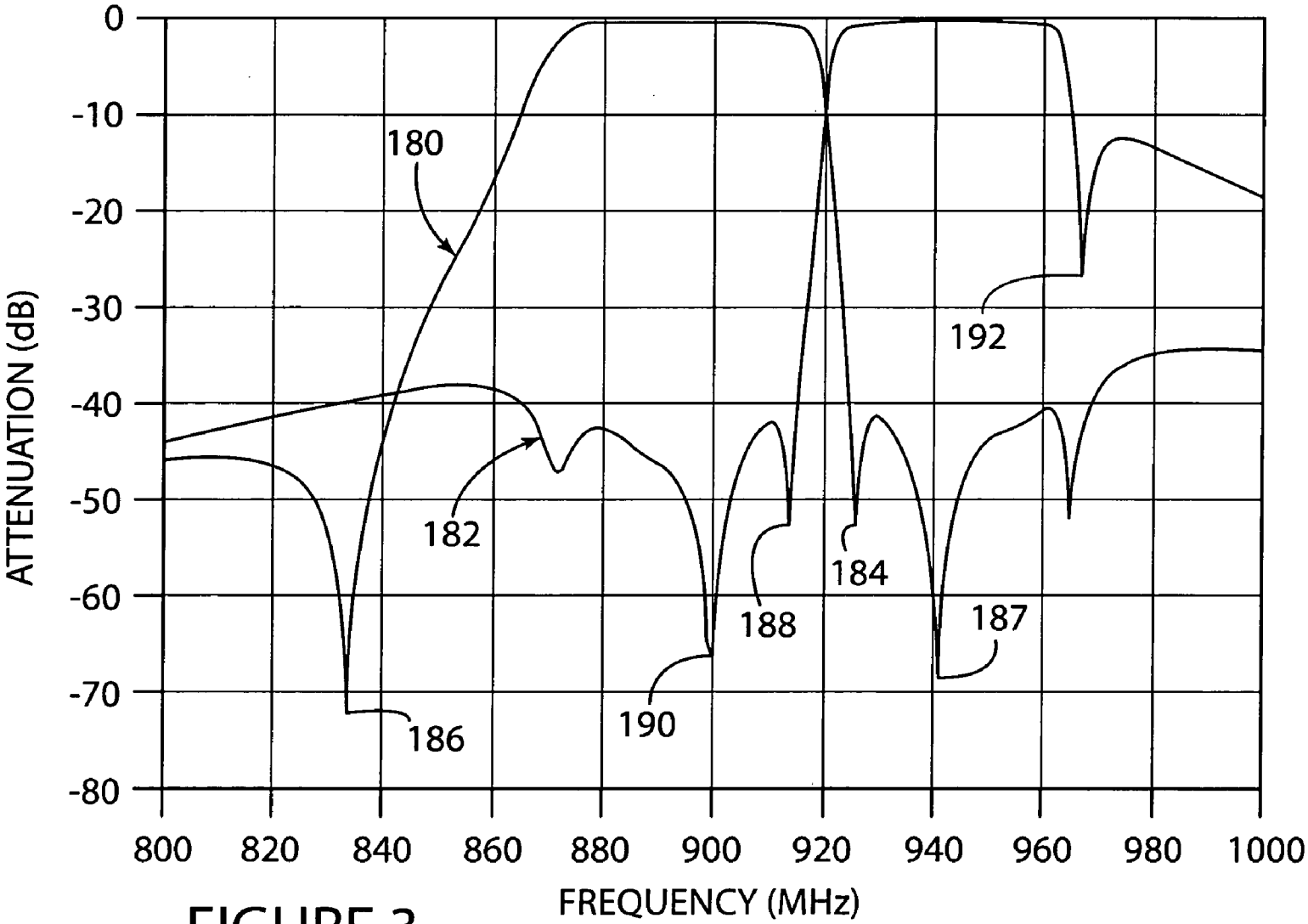
FIG. 3 is a frequency response graph showing the simulated low band and high band performance characteristics of the duplexer filter of FIG. 1.

In accordance with the quadruplet cross-coupling feature of the present invention, the outgoing Tx signal at resonator 122 and the incoming Rx signal at resonator 126 respectively splits into each of the respective main and bypass paths and recombines as a filtered signal at respective Tx resonator 125 and Rx resonator 126 respectively. If the signals are of equal amplitude and opposite phase when such signals are recombined at respective resonators 125 and 126, then the main and bypass signals will cancel each other out and result in a null. This result occurs at one frequency below the passband and another frequency above the passband. As shown in FIG. 3 which is a graph of the simulated frequency response of filter 100 for both the low band (designated by the line 180) and the high band (designated by the line 182), the null frequencies are located approximately symmetrical around the passband, thus advantageously creating a nearly symmetrical filter response. Where the two null frequencies are very close to the passband, the filter response tends to be more symmetrical.

More specifically, and referring to FIG. 3, it is understood that null notch point 184 on line 180 represents the response of the low band shunt zero and that null notch points 186 and 187 represent the responses of the two low band quadruplet zeros respectively. Null notch point 188 on line 182 represents the response of the high band shunt zero while null notch points 190 and 192 represent the responses of the two high band quadruplet zeros respectively.

Figure 4:
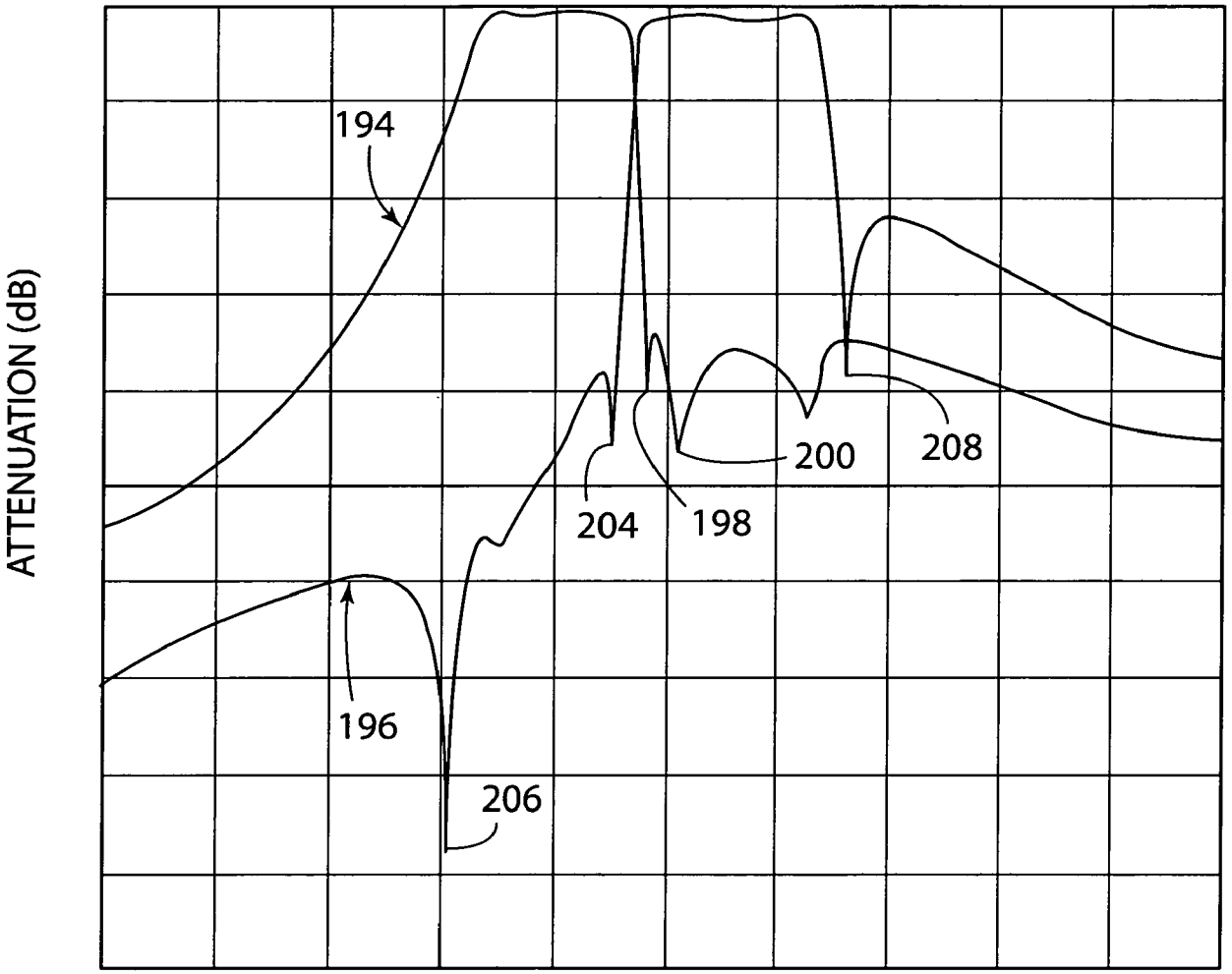
FIG. 4 is a frequency response graph showing the actual measured low band and high band performance characteristics of the duplexer filter of FIG. 1.

FIG. 4 is a graph depicting the actual measured frequency response of filter 100 for both the low band (designated by line 194) and the high band (designated by line 196). In FIG.

4, null notch point 198 represents the response of the low band shunt zero while the null notch point 200 represents the response of the high side low band quadruplet zero. Null notch point 204 on line 196 represents the response of the high band shunt zero while the null notch points 206 and 208 represent the responses of the two high band quadruplet zeros respectively.

Numerous variations and modifications of the embodiment described above may be effected without departing from the spirit and scope of the novel features of the invention. No limitations with respect to the specific module illustrated herein are intended or should be inferred.

What is claimed is:

1. A ceramic monoblock filter, comprising:

a block of dielectric material defined by top, bottom, and side surfaces wherein said side and bottom surfaces are substantially covered with a conductive material;

at least first, second, third and fourth spaced-apart resonators defined by at least four adjacent resonator through-holes extending between the top and bottom surfaces of said block and surrounded on the top surface by conductive material defining conductive resonator plates;

at least first and second pads of conductive material defined on the top surface, the first pad being located adjacent said conductive resonator plate of said first resonator and the second pad being located adjacent said conductive resonator plate of said fourth resonator;

an external bypass transmission electrode seated on and extending on the top surface of the block between said first pad adjacent said conductive resonator plate of said first resonator and said second pad adjacent said conductive resonator plate of said fourth resonator to provide a capacitive cross-coupling directly between said first and fourth resonators; and inductive coupling means located between each of said first through fourth resonators for providing a conductive coupling between said first through fourth resonators and comprising first, second, and third elongate notches extending only into the dielectric material on said top surface of said block between said first and second, second and third, and third and fourth resonators respectively, the respective notches being covered with conductive material.

2. A ceramic monoblock filter, comprising:

a block of dielectric material defined by top, bottom, and side surfaces wherein said side and bottom surfaces are substantially covered with a conductive material;

at least first, second, third and fourth spaced-apart resonators defined by at least four adjacent resonator through-holes extending between the top and bottom surfaces of said block and surrounded on the top surface by conductive material defining conductive resonator plates;

at least first and second pads of conductive material defined on the top surface, the first pad being located adjacent said conductive resonator plate of said first resonator and the second pad being located adjacent said conductive resonator plate of said fourth resonator;

an external bypass transmission electrode seated on and extending on the top surface of the block between said first pad adjacent said conductive resonator plate of said first resonator and said second pad adjacent said conductive resonator plate of said fourth resonator to provide a capacitive cross-coupling directly between said first and fourth resonators;

said block of dielectric material defining longitudinal and transverse side surfaces, said external bypass transmission electrode being defined by a bar composed of a material having a dielectric constant less than the dielectric constant of the material comprising said block of said filter, said ends of said bar being seated on said respective first and second pads and a strip of conductive material being disposed on said bar for conductively connecting said first pad to said second pad, said bar being located on the top surface of the block in the space between said conductive resonator plates surrounding said first, second, third, and fourth resonators and one of said longitudinal side surfaces of said block; and inductive coupling means located between each of said first through fourth resonators for providing a conductive coupling between said first through fourth resonators.

3. The filter of claim 2 wherein said bar is composed of a ceramic material.

4. The filter of claim 2 wherein said bar is straight.

5. A ceramic monoblock duplexer filter adapted for connection to an antenna, a transmitter and a receiver for filtering an incoming signal from the antenna to the receiver and for filtering an outgoing signal from the transmitter to the antenna, the duplexer filter comprising a dielectric block having top, bottom, and side surfaces, and comprising:

an antenna electrode pad on the block;

a transmit section extending between the antenna electrode and one end of the block, said transmit section defining at least first, second, third, and fourth through-hole resonators defined in part by respective first, second, third, and fourth resonator plates formed on the top surface;

a receive section extending between the antenna electrode pad and the other end of the block, said receive section defining at least first, second, third, and fourth through-hole resonators defined in part by respective first, second, third, and fourth resonator plates formed on the top surface;

a transmit electrode pad on the block spaced from the antenna electrode pad and positioned in the transmit section;

a receive electrode pad on the block spaced from the antenna electrode pad and positioned in the receiver section;

first and second conductive pads disposed on said top surface adjacent said first and fourth through-hole resonator plates respectively of each of said transmit and receive sections;

first and second external bypass electrodes adapted to be seated on said first and second conductive pads in said transmit and receive sections respectively; and inductive coupling means located on said top surface of said block between each of said first through fourth through-hole resonators in said transmit and receive sections respectively for inductively coupling said first through fourth through-hole resonators in said transmit and receive sections respectively, said inductive coupling means comprising first, second, and third elongate notches extending only into the dielectric material of said block and positioned between said first and second, second and third, and third and fourth resonators respectively, the respective first, second, and third notches being covered with conductive material.

6. The filter of claim 5 wherein said external bypass transmission electrode is defined by a separate bar composed of a material having a dielectric constant less than the dielectric constant of the material comprising said block of said filter, said ends of said bar being seated on said respective first and second pads and a strip of conductive material being disposed on said bar for conductively connecting said first pad to said second pad.

7. The filter of claim 6 wherein said bar is composed of a ceramic material.

8. The filter of claim 6 wherein said bar is straight.

9. A ceramic monoblock filter including a direct signal path defined by at least first, second, third, and fourth spaced-apart through-hole resonators and a separate quadruplet cross-coupling alternate signal path defined by a separate external bridge member which interconnects and couples the first and fourth through-hole resonators and is made of a material having a lower dielectric constant than the ceramic monoblock filter.

10. The filter of claim 9 defined by a block of material, the bridge member being made of a ceramic material having a lower dielectric constant than the ceramic material of the block.

* * * * *